US006213639B1

(12) United States Patent
Hell et al.

(10) Patent No.: US 6,213,639 B1
(45) Date of Patent: Apr. 10, 2001

(54) LOW-COST X-RAY RADIATOR

(75) Inventors: Erich Hell; Detlef Mattern, both of Erlangen; Thomas Ohrndorf, Altendorf; Peter Schardt, Roettenbach, all of (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/391,081

(22) Filed: Sep. 16, 1999

(30) Foreign Application Priority Data

Sep. 23, 1998 (DE) ..... 198 43 649

(51) Int. Cl.[7] ..... H01J 35/10
(52) U.S. Cl. ..... 378/200
(58) Field of Search ..... 378/199, 200

(56) References Cited

U.S. PATENT DOCUMENTS 5,703,926 12/1997 Bischof .
5,883,936 3/1999 Hell et al. .
6,084,942 * 7/2000 Hell ..... 378/200

* cited by examiner

*Primary Examiner*—Craig E. Church
(74) *Attorney, Agent, or Firm*—Schiff Hardin & Waite

(57) ABSTRACT

An x-ray radiator has a rotary-bulb tube, whose vacuum enclosure rotates inside a radiator housing, which is filled with a liquid cooling medium, and a cooling medium conducting body is arranged between the vacuum enclosure and the radiator housing, at a distance from both of these. The cooling medium conducting body produces a flow of the cooling medium along the vacuum enclosure in the inner gap and a return flow of the cooling medium along the radiator housing in the outer gap, promoted by the rotation of the rotary-bulb tube.

9 Claims, 1 Drawing Sheet

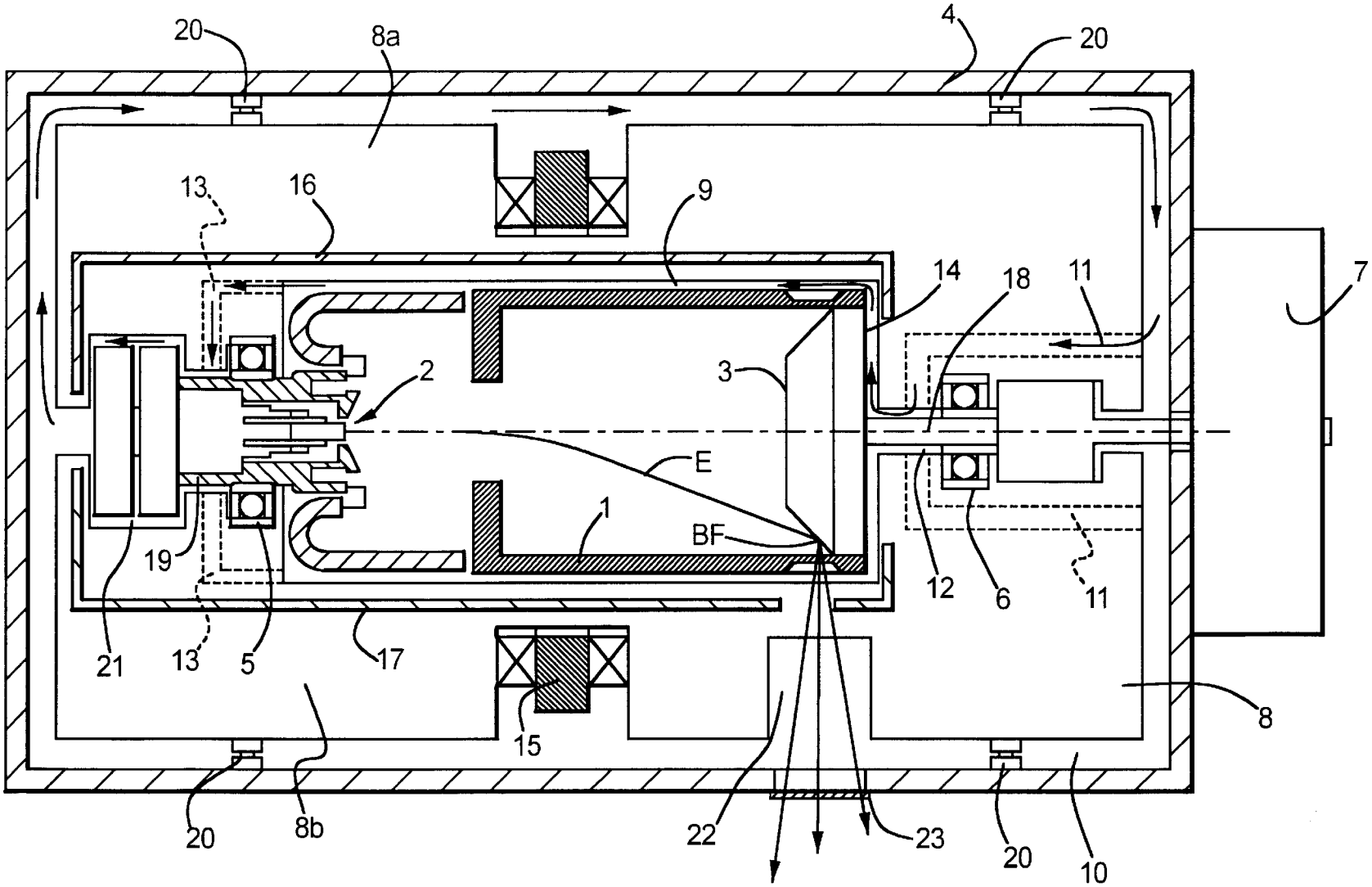
7
8
10
20
11
11
18
6
20
4
14
12
23
3
E
BF
22
9
1
15
2
8a
17
16
8b
5
20
13
13
19
20
21

LOW-COST X-RAY RADIATOR

BACKGROUND OF THE INVENTION

1. Field of the Invention

The present invention relates to an x-ray radiator of the rotary-bulb type having a vacuum enclosure which rotates within the radiator housing during the operation of the x-ray radiator, the radiator housing, being filled with a liquid cooling medium.

2. Description of the Prior Art

In x-ray radiators such as this, oil pumps and external coolers are sometimes forgone for reasons of cost. This means that in x-ray radiators of this type the high heat energy which is created in the x-ray conversion must be stored in the anode, and the stored heat is then conveyed to the liquid cooling medium, from which it can be released into the environment exclusively by means of convection. In turn, this means that x-ray radiators of this type can only by designed for an average power of a few 100 Watts. Besides this power limitation, a further disadvantage is that the overall cooling medium volume (generally insulating oil) of the x-ray radiator is not heated uniformly by the heat arising locally in the vicinity of the anode, and so heat is not uniformly converted through the surface of the x-ray radiator, which means that the x-ray radiator cannot be operated at a continuous power which would be optimal for the volume. Finally, in x-ray radiators of this type the danger exists that parts of the housing in the region of the anode may exceed the allowable temperature limits.

If it is desired to increase the power of x-ray radiators without external coolers, a forced-air cooling can be introduced, however, this does not solve the problem of uneven heat discharge by the tube. Besides a limited possibility to increase power, the cost reduction resulting from the avoidance of the external cooler, which is desirable, is not achieved with such a forced-air cooling, or only to a certain extent.

SUMMARY OF THE INVENTION

An object of the present invention is to provide an x-ray radiator of the type described above wherein it is possible to increase the power without external coolers or cooling medium pumps, while at the sane time the danger of thermal overloads of individual regions of the x-ray radiator is at least diminished.

This object is inventively achieved in an x-ray radiator having a cooling medium conducting body arranged between the vacuum enclosure and the radiator housing, spaced a distance from both, which body effects a flow of cooling medium along the vacuum enclosure in an inner gap located between the cooling medium conducting body and the vacuum enclosure, and a return flowing of the cooling medium along the radiator housing in an outer gap located between the body and the radiator housing. The transport of the cooling medium through the inner and outer gaps is effected by means of the rotation of the vacuum enclosure.

On the basis of the inventive construction, the cooling medium flows along the vacuum enclosure, cooling the anode, in particular, so as to avoid temperature peaks (hot spots) in the region of the anode, which were unavoidable in conventional radiator without circulating the cooling medium by means of a pump. After the heat absorption by the vacuum enclosure, the oil flows in the outer gap at the inner wall of the radiator housing and is thereby cooled. The flow against practically the entire inner wall of the radiator housing produces an appreciably better heat dissipation than was the case in conventional x-ray radiators without circulation of the cooling medium by means of a pump, in which the cooling medium is intensely heated in an uneven manner and, for lack of a forced-air circulation, does not even exploit the entire cooling surface of the radiator housing.

In the invention, the fact that an uneven pressure distribution develops in the interior of the radiator housing due to the rotation of the vacuum enclosure is exploited for the purpose of circulating the cooling medium, so that, after it has flowed along the vacuum enclosure through the inner gap and has absorbed heat therefrom, the cooling medium flows through the outer gap and here releases the absorbed heat to the radiator housing, and thus into the environment, before being transported again into the inner gap, now cooled. As long as the unevenness of the pressure distribution in the radiator housing suffices for transporting the cooling medium without special measures being taken, those skilled in the art can, without undue experimentation, influence the unevenness of the pressure distribution by a corresponding shaping of the cooling medium conducting body and the vacuum enclosure, as well as by a suitable dimensioning of the width of the inner and outer gaps, so that the pressure difference between regions with low pressure and regions with high pressure suffices for purposes of circulating the cooling medium.

A particularly intensive circulation of the cooling medium is achieved in an embodiment wherein the outer gap is connected by connecting lines, which are implemented in the cooling medium conducting body, to inlets and outlets of the inner gap, which are arranged at points of the inner gap at which there is a low pressure, or a high pressure, in the cooling medium consequent to the rotation of the vacuum enclosure.

For a particularly effective circulation of the cooling medium, in a preferred embodiment the vacuum enclosure rotates around an rotational axle, and the cooling medium conducting body has faces which extend transversely to the rotational axle, and inlets and outlets for the cooling medium respectively empty into a section of the outer gap adjacent a face of the cooling medium conducting body, in the vicinity of the rotational axle. Since the inlets and outlets empty into the sections of the outer gap that neighbor the faces, in the vicinity of the rotational axle, the cooling medium located in the outer gap flows against practically the entire wall of the radiator housing, so that nearly the entire wall of the radiator housing contributes to heat dissipation.

In a further embodiment of the invention, the cooling medium conducting body is an essentially cylindrical metal or plastic injection-molded part, which is preferably divided along a longitudinal center plane. It is advantageous particularly in the embodiment having a plastic injection-molded part, to embed lead shielding shells in the cooling medium conducting body.

DESCRIPTION OF THE DRAWINGS

The single side view, partly in section, of a low-cost x-ray radiator constructed in accordance with the principles of the present invention.

DESCRIPTION OF THE PREFERRED EMBODIMENTS

In the FIGURE, a rotary-piston tube having a vacuum enclosure 1 is shown. Rotary-bulb tubes of this type are described in U.S. Pat. No. 5,883,936, the disclosure of which is incorporated herein by reference.

In the vacuum enclosure 1, the rotary-bulb tube contains a cathode 2 and, arranged opposite thereto, an anode 3, which is permanently connected to the vacuum enclosure 1 and which represents a part of the vacuum enclosure 1.

The vacuum enclosure 1 with the cathode 2 and the anode 3 rotates inside a radiator housing 4 around an rotational axle (indicated in the FIGURE by a dotted line) and is provided with shaft stubs 18,19, which are mounted at bearings that are fashioned as roller bearings 5 and 6 in the exemplary embodiment. A drive motor 7, which is connected to the shaft stub 18 and which serves to cause the rotary-bulb tube to rotate, is schematically indicated.

An electron beam E emanates from cathode 2 and is focused by focusing means in a known fashion. The electron beam E is deflected onto a stationary focal spot on the anode 3 in known fashion, using a magnet system 15, as taught in U.S. Pat. No. 5,883,936. The magnet system 15 surrounds the vacuum enclosure 1 and is stationary relative thereto, i.e. it does not rotate therewith.

The interior space between the vacuum enclosure 1 and the radiator housing 4 is filled with a cooling medium, particularly an insulating oil. A cooling medium conducting body 8, which does not rotate with the rotary-bulb tube, is arranged in the radiator housing 4. The cooling medium conducting body 8 forms an inner gap 9 along the vacuum enclosure 1 and an outer gap 10 at the inner side of the radiator housing 4, and is connected to the radiator housing 4 via schematically indicated rod-type supports 20, a few of which are illustrated in the FIGURE. Like the vacuum enclosure 1, the cooling medium conducting body 8 is constructed so as to be essentially rotationally-symmetrical to the rotational axle, and it supports the rotary-bulb tube in the radiator housing 4, which is mounted in the cooling medium conducting body 8 so as to rotate by means of the roller bearings 5 and 6.

The outer gap 10 is connected to the inner gap 9 in the region of the anode 3 by connecting lines 11, which are arranged in the vicinity of the rotational axle in the face of the cooling medium conducting body 8 that extends transversely to the rotational axle. The lines 11 are preferably constructed as bores in the cooling medium body 8. The connecting lines 11 empty into a feed channel 12 that functions as an inlet, the channel 12 surrounding the shaft stub 18 concentrically and thus emptying into the outer gap 10 in the region of the rotational axle. The inner gap 9, which extends along the outer face 14 of the anode 3 and subsequently along the vacuum enclosure 1, is connected to the region of the outer gap 10 located between the cooling medium conducting body 8 and the radiator housing 4, via additional connecting lines 13 which are provided in the cooling medium conducting body 8 in the region of the face of the cooling medium conducting body 8 away from the connecting lines 11. The connecting lines 13 communicate with a drain channel 21 that functions as an outlet, the channel 21 concentrically surrounding the tubular shaft stub 19 that supports the cathode 2, thus emptying into the outer gap 10 in the region of the rotational axle.

As a consequence of the rotation of the rotary-bulb tube, an uneven pressure distribution arises in the cooling medium, which guarantees a forced circulation of the cooling medium (indicated by arrows), due to the placement of the feed channel 12 in a region of high pressure and the drain channel 21 in a region of low pressure. This circulation is of a nature such that the cooling medium in the inner gap 9 is transported along the anode 3 and the vacuum enclosure 1 to the connecting lines 13 in the inner gap 9, and is transported, via the drain channel 21, along the wall of the radiator housing 4 and back to the connecting lines 11 in the outer gap 10.

The cooling medium conducting body 8, which is constructed as an injection-molded part made of metal or plastic, and which is not cross-hatched in the FIGURE in order to make the FIGURE easier to survey, is composed of two half-shells 8*a* and 8*b*, which are divided in the longitudinal center plane. Schematically indicated lead shielding shells 16 and 17, which are provided for radiation protection, are embedded in the half-shells of the cooling medium conducting body 8.

The magnet system 15 is accepted in a suitably formed slot of the cooling medium conducting body 8, so that additional assembly space for the magnet system 15 is not required. To the extent as may be necessary for the functioning of the magnet system 15, the lead shielding shells 16 and 17 can be provided with gaps in the region thereof situated inside the magnet system 15.

A gap is provided in that region of the lead shielding part 17 in which the x-rays, indicated by arrows, proceed to the exterior through the vacuum enclosure 1. In a corresponding region, the cooling medium conducting body 8 is provided with a recess 22, and the radiator housing 4 is provided with a radiation exit window 23, in order to prevent unnecessary attenuation of the x-rays.

Instead of through the drain channel 21 along the outer side of the shaft stub 19, as depicted in the FIGURE, the cooling medium can be conducted into the interior of the shaft stub 19 through openings therein and can flow from there into the outer gap, so that the shaft stub functions 19 as drain channel.

Although modifications and changes may be suggested by those skilled in the art, it is the intention of the inventors to embody within the patent warranted hereon all changes and modifications as reasonably and properly come within the scope of their contribution to the art.

We claim as our invention:

1. An x-ray radiator comprising:

a radiator housing;

a liquid cooling medium filling said radiator housing;

a rotary bulb x-ray tube having a vacuum enclosure rotatably mounted in said liquid cooling medium in said radiator housing; and a cooling medium conducting body disposed between said vacuum enclosure and said radiator housing and being spaced from each of said vacuum enclosure and said radiator housing, said cooling medium conducting body, upon rotation of said rotary-bulb tube, producing a flow of said cooling medium along said vacuum enclosure in an inner gap located between said cooling medium conducting body and said vacuum enclosure, and a return flow of said cooling medium in an outer gap disposed between said cooling medium conductor body and said radiator housing.

2. An x-ray radiator as claimed in claim 1 wherein rotation of said rotary bulb tube produces a high pressure location at said inner gap and a low pressure location at said inner gap, and wherein said inner gap has an inlet and an outlet respectively communicating with said outer gap, said inlet being disposed at one of said high pressure location and said low pressure location, and said outlet being disposed at the other of said high pressure location and said low pressure location.

3. An x-ray radiator as claimed in claim 2 wherein said rotary-bulb tube has a rotational axle around which said vacuum enclosure rotates, wherein said cooling medium conducting body has end faces oriented transversely to said rotational axle, and wherein said inlet and said outlet respectively empty into a section of said outer gap adjacent one of said end faces of said cooling medium conducting body, in a region of said rotational axle.

4. An x-ray radiator as claimed in claim 1 wherein said cooling medium conducting body is substantially cylindrical, and is divided longitudinally into two parts.

5. An x-ray radiator as claimed in claim 4 wherein said rotary-bulb tube has a rotational axle around which said vacuum enclosure rotates, and wherein said cooling medium conducting body is divided in a longitudinal center plane containing said rotational axle.

6. An x-ray radiator as claimed in claim 4 further comprising at least one lead shielding element embedded into each of said two parts of said cooling medium conducting body.

7. An x-ray radiator as claimed in claim 1 comprising lead shielding elements embedded in said cooling medium conducting body.

8. An x-ray radiator as claimed in claim 1 wherein said cooling medium conducting body is comprised of metal.

9. An x-ray radiator as claimed in claim 1 wherein said cooling medium conducting body is comprised of plastic.

* * * * *